US010836596B2

(12) United States Patent
Terrero et al.

(10) Patent No.: US 10,836,596 B2
(45) Date of Patent: Nov. 17, 2020

(54) REGISTRATION SYSTEM WITH TRANSLATING CARRIAGE AND OMNI WHEELS

(71) Applicant: Xerox Corporation, Norwalk, CT (US)

(72) Inventors: Carlos M. Terrero, Ontario, NY (US); Michael J. Linder, Walworth, NY (US); Roberto A. Irizarry, Rochester, NY (US); Jeffrey N. Swing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/948,580

(22) Filed: Apr. 9, 2018

(65) Prior Publication Data

US 2019/0308835 A1 Oct. 10, 2019

(51) Int. Cl.

| | |
|---|---|
| ***B65H 9/00*** | (2006.01) |
| ***B65H 9/20*** | (2006.01) |
| ***B41J 13/26*** | (2006.01) |
| ***B41J 11/44*** | (2006.01) |
| *B65H 5/06* | (2006.01) |

(52) U.S. Cl.

CPC ..... *B65H 9/002* (2013.01); *B41J 11/44* (2013.01); *B41J 13/26* (2013.01); *B65H 9/20* (2013.01); *B65H 5/062* (2013.01); *B65H 2404/15212* (2013.01)

(58) Field of Classification Search

CPC ..... B65H 9/002; B65H 5/062; B65H 2404/15212; B41J 13/32; B65G 2207/34

See application file for complete search history.

(56) References Cited

U.S. PATENT DOCUMENTS

| | | | | |
|---|---|---|---|---|
| 5,094,442 | A | 3/1992 | Kamprath et al. | |
| 5,678,159 | A | 10/1997 | Williams et al. | |
| 7,686,299 | B2 * | 3/2010 | Herrmann | B65H 9/12 271/228 |
| 9,156,642 | B2 | 10/2015 | Dunham et al. | |
| 10,109,138 | B2 * | 10/2018 | Lundblad | G07F 19/202 |
| 10,370,212 | B1 * | 8/2019 | Atwood | B65H 9/166 |
| 2019/0308834 | A1 * | 10/2019 | Linder | B41J 13/32 |
| 2019/0308836 | A1 * | 10/2019 | McCarthy | B41J 13/32 |

FOREIGN PATENT DOCUMENTS

| | | | | |
|---|---|---|---|---|
| JP | 2015074509 A | * | 4/2015 | B65H 9/002 |
| WO | WO-2016118068 A1 | * | 7/2016 | G07D 11/0036 |

* cited by examiner

*Primary Examiner* — Howard J Sanders

(57) ABSTRACT

A registration system for a printing device and a method for controlling the same are disclosed. For example, the registration system includes at least one sensor, omni wheels, a motor coupled to each omni wheel, a translating carriage, and a processor communicatively coupled to the at least one sensor, the motors, and the translating carriage, wherein the processor calculates a desired movement to move the omni wheels and the translating carriage based on the position of the print media.

10 Claims, 5 Drawing Sheets

REGISTRATION SYSTEM WITH TRANSLATING CARRIAGE AND OMNI WHEELS

The present disclosure relates generally to printing devices and, more particularly, to registration systems with a translating carriage and omni wheels.

BACKGROUND

Printing devices can be used to print images on print media. The print media can be fed through the printing device along a transport path and imaging path to have the image printed. Along the transport path and the imaging path, there are certain locations where processing errors can occur that can cause a misalignment of the image relative to the print media.

For example, the printing devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

SUMMARY

According to aspects illustrated herein, there are provided a registration system for a printing device and a method for controlling the same. One disclosed feature of the embodiments is a registration system for a printing device comprising at least one sensor to detect a position of a print media, a first omni wheel and a second omni wheel arranged such that a respective center axis of rotation of the first omni wheel and the second omni wheel are perpendicular to a process direction, a first motor coupled to first omni wheel and a second motor coupled to the second omni wheel, a translating carriage located opposite the first omni wheel and the second omni wheel, and a processor communicatively coupled to the at least one sensor, the first motor, the second motor, and the translating carriage, wherein the processor calculates a desired movement of the first motor, the second motor, and the translating carriage to move the first omni wheel, the second omni wheel, and the translating carriage based on the position of the print media.

Another disclosed feature of the embodiments is a method for controlling a position of a print media in a registration system of a printing device. In one embodiment, the method detects a position of a print media, determines a desired movement of a first omni wheel, a second omni wheel, and a translating carriage based on the position of the print media, wherein the first omni wheel and the second omni wheel rotate in a process direction and the translating carriage moves perpendicular to the process direction, and moves the first omni wheel, the second omni wheel, and the translating carriage in accordance with the desired movement to adjust the position of the print media.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure is related to a registration system with a translation carriage and omni wheels and a method for registering a print media using the omni wheels. As discussed above, printing devices can have a registration system. The registration system may be responsible for correctly feeding the print media to an imaging system such that the printed image is correctly aligned with the print media. As the size and weight of print media grows larger and larger, it can be more and more difficult for currently designed registration systems to handle the larger print media.

Registration systems may include center registered systems and edge registered systems. Current designs for some registration systems require the use of three nips and/or a movable registration carriage. The movable registration carriage may help adjust for lateral input error.

A center nip may be vertically movable (e.g., up and down). As a result, for smaller sheets of print media, the center nip may be moved down to engage the print media. For larger sheets of print media, the center nip may be moved up to disengage the print media and allow the outer two nips to engage the print media. Engaging and disengaging the nips may be inefficient.

Embodiments of the present disclosure provide a registration system that uses omni wheels with a translating carriage to correct various alignment errors, such as lateral input errors, skew, and the like. The omni wheels provide greater directional control of the print media within the registration system and simplify the components within the registration system. For example, the omni wheels allow the translating carriage to move simultaneously while the omni wheels are rotating. As a result, the movable registration carriage may be replaced with the omni wheels. The omni wheels may provide skew correction and lateral position correction.

Figure 1:
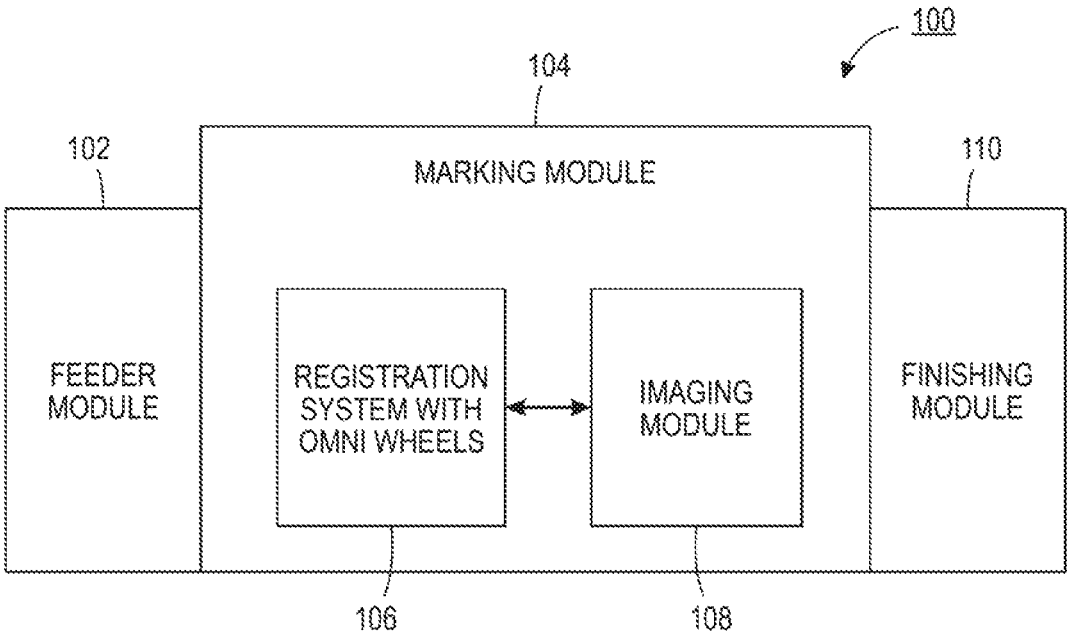
FIG. 1 illustrates a block diagram of example printing device of the present disclosure.

FIG. 1 illustrates a block diagram of an example printing device 100 of the present disclosure. The printing device 100 may be any type of printing device such as a multi-function device (MFD), a copy machine, laser printer, an ink jet printer, and the like.

In one embodiment, the printing device 100 may include a feeder module 102, a marking module 104, and a finishing module 110. The feeder module 102 may include feeder trays that feed print media through the printing device 100.

The marking module 104 may include a registration system 106 with omni wheels and translating carriage, as discussed in further details below, and an imaging module 108. The registration system 106 may be used to align print media such that an image is correctly printed on print media that is fed through the printing device 100. In other words, the registration system 100 may correctly align and position the print media relative to an imaging module 108 that is further downstream from the registration system 100.

The imaging module 108 may print a desired image onto the print media. The imaging module 108 may use any type of printing means to print the desired image. For example, the imaging module 108 may include an imaging belt that transfers toner that is dispensed onto the imaging belt onto the print media. In another example, the imaging module 108 may include ink jet print heads that print a desired image onto the print media, and the like.

The finishing module 110 may perform any final processing of the print media after the desired image is printed. For example, the final processing may include, stacking, stapling, collating, organizing, and the like, the print media with the desired printed image.

It should be noted that the printing device 100 has been simplified for ease of explanation. The printing device 100 may include additional modules or components that are not shown. For example, the printing device 100 may include a graphical user interface (GUI), a digital front end, a processor, a memory storing instructions that are executed by the processor, a duplex return path, and the like.

Figure 2:
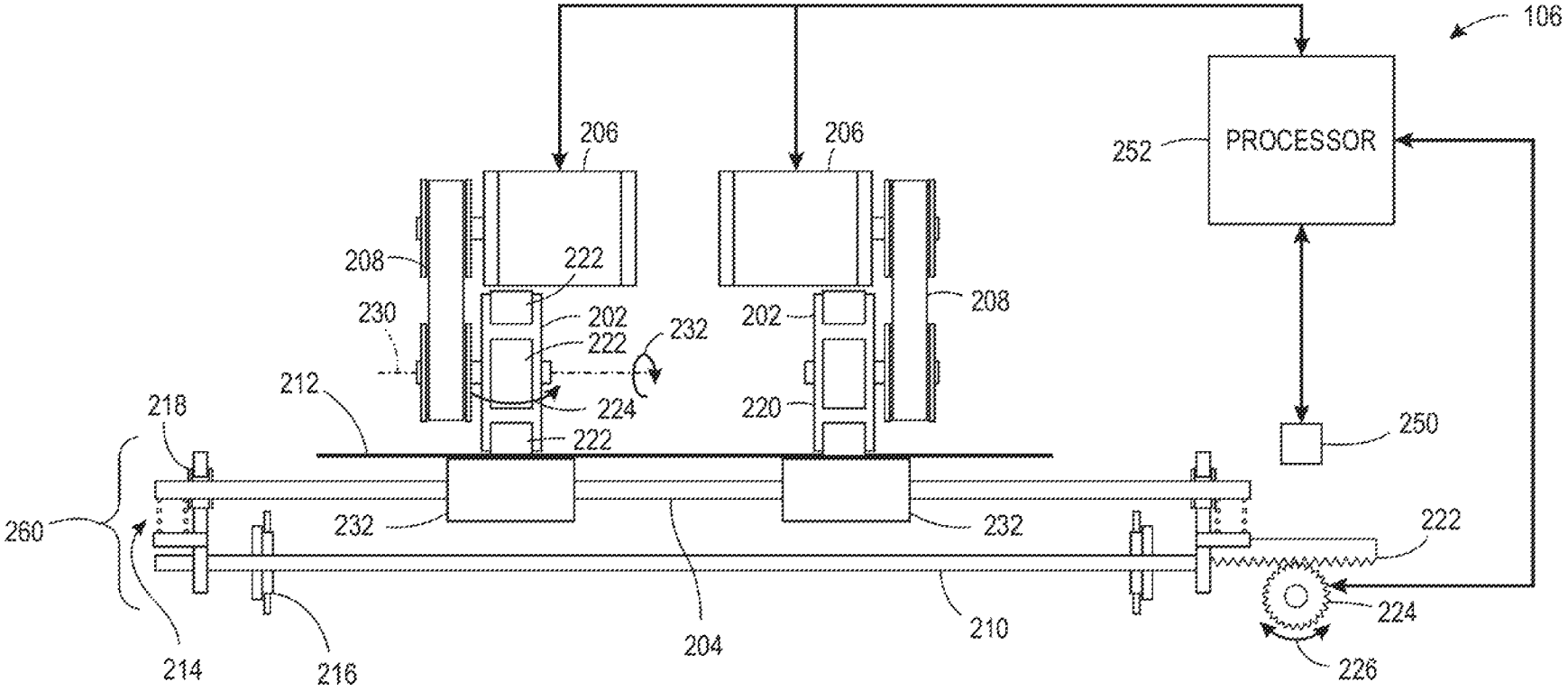
FIG. 2 illustrates a cross-sectional view in a process direction of an example registrations system with a translation carriage and omni wheels of the present disclosure.

FIG. 2 illustrates a cross-sectional view of a front, or in a process direction, of an example of the registration system 106. It should be noted that the FIG. 2 has been simplified for ease of explanation. The registration system 106 may include additional components that are not shown (e.g., additional transport nips, a housing, rails, electrical connections, and the like).

In one embodiment, the registration system 106 may include omni wheels 202. Although two omni wheels 202 are illustrated in FIG. 2, it should be noted that any number of omni wheels 202 may be deployed in the registration system 106.

Each omni wheel 202 may be coupled to a respective motor 206 via a belt 208. Each omni wheel 202 may include a central body portion 220. The central body portion 220 may rotate around a central axis of rotation 230. The central body portion 220 may rotate around the central axis of rotation 230 as shown by the arrow 232.

In one embodiment, if the omni wheels 202 are not used to adjust for skew, the omni wheels 202 may be mounted on the same shaft and driven with a single motor 206. Thus, the omni wheels 202 may rotate at the same speed when skew adjustment is not needed.

Each omni wheel 202 may also include a plurality of roller components 222 coupled to an outer periphery of the central body portion 220. Each one of the plurality of roller components 222 may rotate around an axis that is perpendicular to the respective center axis of rotation 230. For example, if the omni wheel 202 rotates around the center axis of rotation 230, the plurality of roller components 222 may rotate around an axis that is perpendicular to the center axis of rotation 230 as shown by an arrow 224.

In one embodiment, the plurality of roller components 222 may have a cylindrical, a rounded cylindrical, or a spherical like shape and freely rotate in a direction as shown by the arrow 224. The plurality of roller components 222 may be spaced evenly apart around the outer periphery of the central body portion 220.

In one embodiment, the central body portion 220 and the plurality of roller components 222 may be comprised of any type of material. In one example, the central body portion 220 and the plurality of roller components 222 may be fabricated from a plastic or a rubber type material.

In one embodiment, the omni wheels 202 may be each located on a same side of a print media 212 that enters the registration system 106. For example, the omni wheels 202 may all be located below the print media 212. In one embodiment, the omni wheels 202 may be located on a "top" side of the print media 212.

In one embodiment, the omni wheels 202 may be positioned in opposing pairs adjacent to one another on a same side of the print media 212. For example, the omni wheels 202 may include a first omni wheel and a second omni wheel that are located across from one another on the same side of the print media 212. The omni wheels 202 may be aligned such that a center of the first omni wheel 202 and a center of the second omni wheel 202 share a same central axis of rotation 230.

The omni wheels 202 may be spaced apart by a distance that is approximately a width of the print media 212. In one embodiment, the width may be the smallest width of a print media 212 that may be fed in the printing device 100. For example, if the printing device 100 can handle print media having widths of 8.5 inches, 11 inches, and 14 inches, the omni wheels 202 may be spaced apart approximately 8.5 inches. In one embodiment, the omni wheels 202 may provide forward drive of the print media 212.

In one embodiment, the registration system 106 may also include a translating carriage 260. The translating carriage 260 may be located on a bottom side of the print media 212. Said another way, the translating carriage 260 may be located below the omni wheels 202.

In one embodiment, the translating carriage 260 may include an idler roller assembly 204. The idler roller assembly 204 may comprise a shaft or cylinder that is approximately a width of a transport path of the registration system 106. The idler roller assembly 204 may include idler rollers 232. In one embodiment, the idler roller assembly 204 may include a first idler roller 232 and a second idler roller 232. The idler rollers 232 may be fabricated from a plastic or a rubber. The idler rollers 232 may have a cylindrical shape and have a larger diameter than the shaft of the idler roller assembly 204. The shaft of the idler roller assembly 204 may run through a center of the idler rollers 232. The first idler roller 232 may be located adjacent to, or aligned with, the first omni wheel 202 and the second idler roller 232 may be located adjacent to, or aligned with, the second omni wheel 202.

In one embodiment, the translating carriage 260 may include a support shaft 210 that is coupled to the idler roller assembly 204 via at least one spring 214. The spring 214 may provide a nip force to allow the idler rollers 232 to press the print media 212 against the omni wheels 202.

In one embodiment, a translating rack 222 may be coupled to the support shaft 210. A translating pinion 224 may be in contact with, or coupled to, the translating rack 222. The translating pinion 224 may be rotated, as shown by an arrow 226, to cause the translating rack 222 to move laterally (e.g., left or right, or in an inboard direction and an outboard direction). Thus, the movement of the translating rack 222 may allow the translating carriage 260 to move in a lateral direction.

Although the mechanical movement control of the translating carriage 260 is illustrated as a translating rack 222 and a translating pinion 224, it should be noted that any mechanical device can be used. For example, the support shaft 210 may be coupled to a lead screw to provide lateral movement, an electric motor, and the like.

The translating carriage 260 may include at least one bearing 218 and at least one bushing or linear bearing 216.

The bearing 218 limits the idler roller assembly 204 to a rotational movement. The bushing 216 may limit the support shaft 210 to a linear movement (e.g., in an inboard or an outboard direction).

In one embodiment, the registration system 106 may also include a processor 252 and one or more sensors 250. The processor 252 may be communicatively coupled to the sensors 250, the motor 206 of the omni wheels 202, and the translating pinion 224.

In one embodiment, the sensors 250 may be located upstream from the omni wheels 202 and the translating carriage 260. In one embodiment, the sensors 250 may be charge coupled device (CCD) sensors, capacitive sensors, or any other type of sensor, or sensors, that can detect a skew and a lateral position of the print media 212.

In one embodiment, the print media 212 may move along a process direction (e.g., into the page). The print media 212 may move past, or over, the sensors 250 depending on where the sensors 250 are located. The sensors 250 may detect a position of the print media 212. In one embodiment, the position may include a skew and a lateral position of the print media 212. The skew and the lateral position of the print media 212 may be transmitted to the processor 252.

The processor 252 may then calculate a desired movement of the motors 206 and the translating pinion 224 based on the position of the print media 212. The desired movement may be to control the motors 206 such that the omni wheels 202 adjust a skew of the print media 212 to zero degrees. In other words, the print media 212 may be moved such that a leading edge of the print media 212 is perpendicular to the process direction.

The desired movement may also be to control the translating pinion 224 such that the translating carriage 260 adjusts a lateral position of the print media 212 relative to a desired alignment position. For example, if the printing device 100 is an edge registered device, the amount of desired movement may be an amount to laterally move the print media 212 to the alignment edge. In another example, if the printing device 100 is a center registered device, the amount of desired movement may be an amount to laterally move (either inboard, or outboard) the print media 212 to the center of the system 200 or the center of the registration system 106.

In one embodiment, the design of the omni wheels 202 may allow the translating carriage 260 to move laterally simultaneously with the rotation of the omni wheels 202. As a result, the registration system 106 of the present disclosure may simultaneously correct a skew and a lateral input error of the print media 212.

In one embodiment, the desired movement may include a speed of rotation of the omni wheels 202. For example, the two omni wheels 202 may be rotated at different speeds to adjust a skew of the print media 212. In one embodiment, the speed of rotation of the omni wheels 202 may each be controlled differently to adjust a skew of the print media 212.

In one embodiment, the desired movement may include an amount of rotation of the translating pinion 224. The amount of rotation of the translating pinion 224 may be equivalent to an amount of lateral movement in an inboard direction or an outboard direction. For example, the translating rack 222 may comprise teeth that mate with an outer surface of the translating pinion 224. The rotation of the translating pinion 224 may move the translating rack 222 in a desired direction via the teeth of the translating rack 222.

Figure 3:
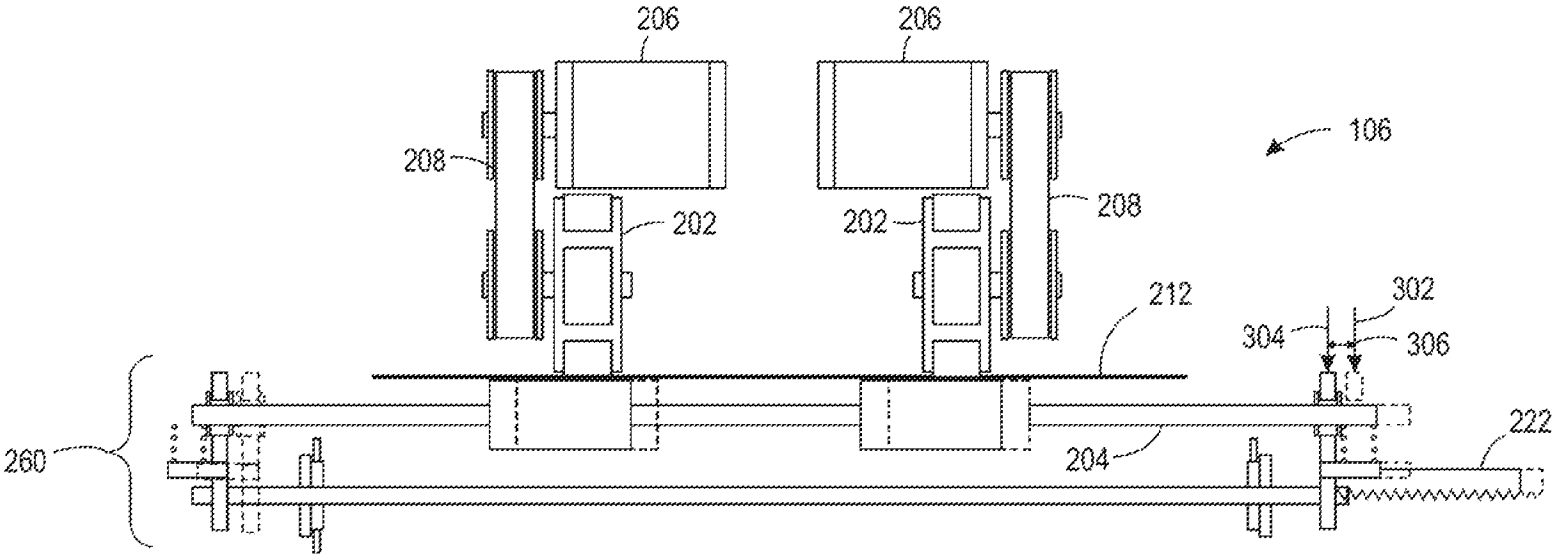
FIG. 3 illustrates a cross-sectional view in the process direction that shows a lateral shift of the example translation carriage with omni wheels of the present disclosure.

FIG. 3 illustrates a cross-sectional view in the process direction that shows a lateral shift of the translation carriage 260. For example, phantom lines are shown at an original position 302. The processor 252 may calculate an amount of lateral error 306 and an amount of rotation of the translating pinion 224 to laterally move the translating rack 222 by the amount of lateral error 306. FIG. 3 illustrates a translated position 304. Thus, in one embodiment, the amount of lateral error 306 may be a direction (e.g., inboard or outboard) and a difference in a distance between the original position 302 and the translated position 304.

As noted above, the omni wheels 202 may be rotated simultaneously as the translating carriage 260 is being moved laterally. The plurality of roller components 222 of the omni wheels 202 may rotated in a direction that is parallel to the lateral movement of the translating carriage 260. As a result, the plurality of roller components 222 may allow the print media 212 to move laterally even as the central body portions 220 of the omni wheels 202 are rotating in the process direction.

Thus, the present disclosure provides a registration system having a translating carriage and omni wheels that can simultaneously adjust a skew and a lateral input error of a print media. The omni wheels may simplify the components of the registration system and allow the registration system to operate more efficiently. The omni wheels may eliminate some delays or inefficiency with previous registration system designs.

Figure 4:
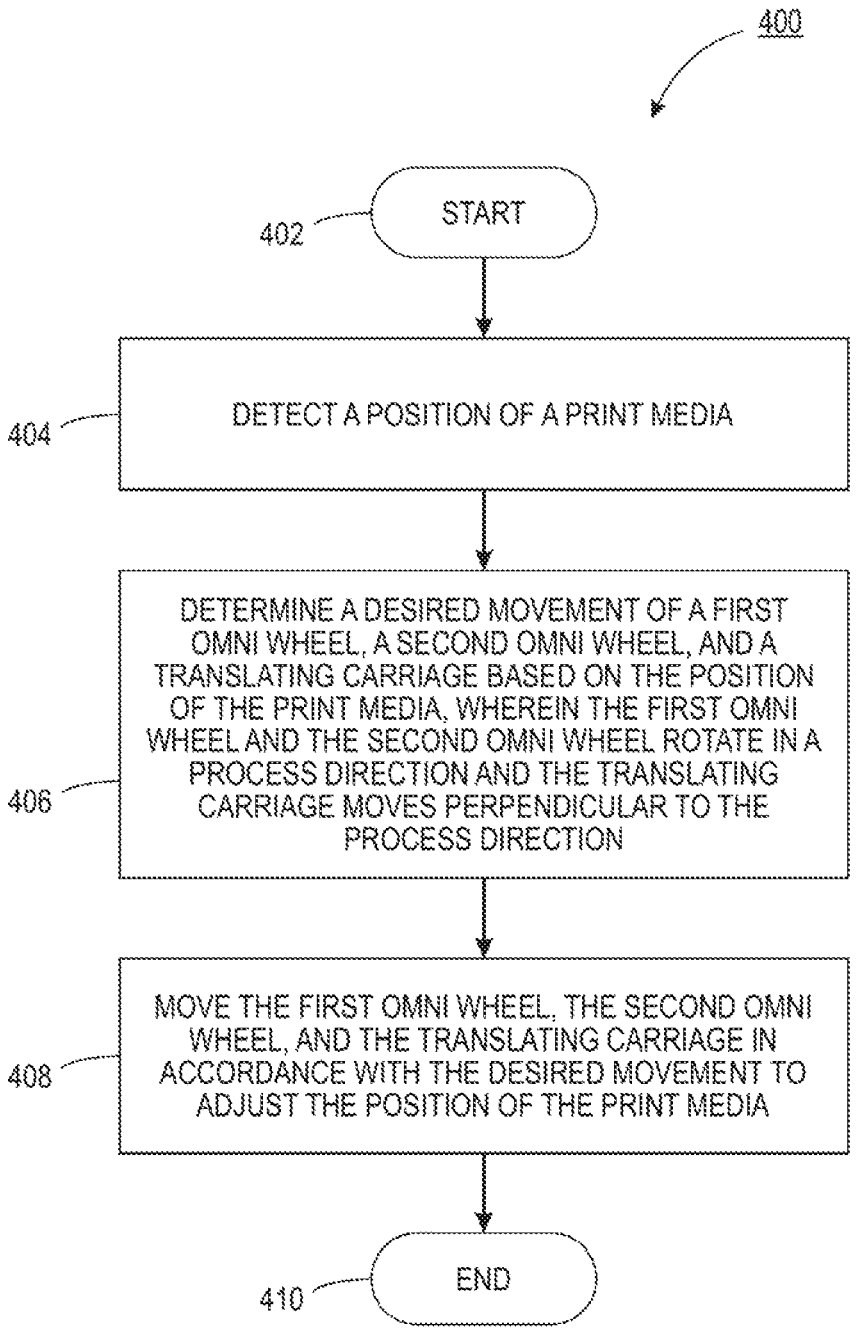
FIG. 4 illustrates a flowchart of an example method for controlling a position of a print media in a registration system of a printing device via at least one omni wheel.
Figure 5:
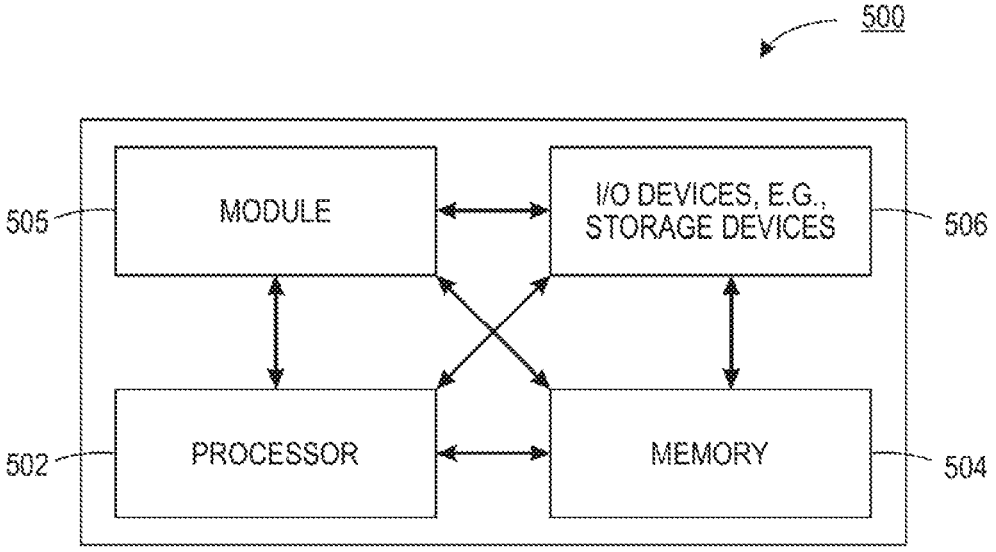
FIG. 5 illustrates a high-level block diagram of an example computer suitable for use in performing the functions described herein.

FIG. 4 illustrates a flowchart of an example method 400 for controlling a position of a print media in a registration system of a printing device via at least one omni wheel. In one embodiment, one or more steps or operations of the method 400 may be performed by the registration system 106, or a computer/processor that controls operation of the registration system 106 as illustrated in FIG. 5 and discussed below.

At block 402, the method 400 begins. At block 404, the method 400 detects a position of a print media. In one embodiment, the print media may be any type of paper.

In one embodiment, one or more sensors may be deployed in the registration system to detect the position of the print media. The sensors may be CCD sensors, capacitive sensors, visual sensors, or any other type of sensor that can detect the position of the print media. The position may include a skew (e.g., an angle that the print media is tilted off of a straight line in the process direction) and a lateral position.

The lateral position may measure an amount that the print media is laterally away from a desired alignment position. For example, for a center registered system, the lateral position may include an amount and a direction (e.g., inboard or outboard) that the print media is off-center. For an edge registered system, the lateral position may include an amount of lateral movement away from the alignment edge.

At block 406, the method 400 determines a desired movement of a first omni wheel, a second omni wheel, and a translating carriage based on the position of the print media, wherein the first omni wheel and the second omni wheel rotate in a process direction and the translating carriage moves perpendicular to the process direction. The first omni wheel, the second omni wheel, and the translating carriage may be arranged as described above in FIG. 2.

In one embodiment, the position of the print media may be used to determine the desired movement. For example, the print media may be laterally positioned 0.5 millimeters (mm) off of the registration edge and have a skew angle of 2 degrees towards the outboard side. The method 400 may determine the desired movement to adjust a position of the print media to move laterally towards the registration edge by 0.5 mm and adjust the skew angle back to 0 degrees.

In one embodiment, the desired movement of the first omni wheel and the second omni wheel may include a rotational speed of the first omni wheel and the second omni wheel. The amount of rotational speed of the activated omni wheels may be based on the amount of movement to needed to adjust the skew of the print media by a desired amount. The desired movement of the translating carriage may include an amount of rotation of a translating pinion to move a translating rack coupled to the translating carriage. The amount of rotation of the translating pinion may be based on an amount of lateral movement needed to adjust the lateral position of the print media by a desired amount.

At block 408, the method 400 moves the first omni wheel, the second omni wheel, and the translating carriage in accordance with the desired movement to adjust the position of the print media. In one embodiment, the first omni wheel and the second omni wheel may be moved by activating a respective motor coupled to the first omni wheel and the second omni wheel. In one embodiment, the translating carriage may be moved by activating a movement mechanism (e.g., a translating pinion coupled to a translating rack, as described above). Control of the motor may control the rotational speed of the first omni wheel and the second omni wheel. Control of the movement mechanism may control lateral movement of the translating carriage.

In one embodiment, the first omni wheel and the second omni wheel may have different rotational speeds. For example, the different rotational speeds of the omni wheels may be used to adjust a skew of the print media. To illustrate, if the first omni wheel is on the inboard side and the second omni wheel is on the outboard side, rotating the first omni wheel faster than the second omni wheel may adjust a skew of the print media towards the inboard side. Similarly, rotating the second omni wheel faster than the first omni wheel may adjust a skew of the print media towards the outboard side.

Using the numerical example in block 406, the motor of the first omni wheel may be controlled to rotate the first omni wheel faster in the process direction than the second omni wheel. Thus, the print media may be pulled towards the inboard side to correct the skew back to 0 degrees. The translating pinion may be rotated by an amount that would be sufficient to move the translating carriage laterally such that the print media is moved 0.5 mm towards the registration edge.

As a result, the omni wheels and the translating carriage of the present disclosure may provide a more efficient design for handling print media within the registration system of a printing device. For example, the omni wheels may be deployed and configured to correct a skew of the print media and the translating carriage may be deployed and configured to correct a lateral input error of the print media. At block 410, the method 400 ends.

It should be noted that the blocks in FIG. 4 that recite a determining operation or involve a decision do not necessarily require that both branches of the determining operation be practiced. In other words, one of the branches of the determining operation can be deemed as an optional step. In addition, one or more steps, blocks, functions or operations of the above described method 400 may comprise optional steps, or can be combined, separated, and/or performed in a different order from that described above, without departing from the example embodiments of the present disclosure.

FIG. 5 depicts a high-level block diagram of a computer that is dedicated to perform the functions described herein. As depicted in FIG. 5, the computer 500 comprises one or more hardware processor elements 502 (e.g., a central processing unit (CPU), a microprocessor, or a multi-core processor), a memory 504, e.g., random access memory (RAM) and/or read only memory (ROM), a module 505 for controlling a position of a print media in a registration system of a printing device via at least one omni wheel, and various input/output devices 506 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements.

It should be noted that the present disclosure can be implemented in software and/or in a combination of software and hardware deployed on a hardware device, a computer or any other hardware equivalents (e.g., the registration system 106). For example, computer readable instructions pertaining to the method(s) discussed above can be used to configure a hardware processor to perform the steps, functions and/or operations of the above disclosed methods. In one embodiment, instructions and data for the present module or process 505 for controlling a position of a print media in a registration system of a printing device via at least one omni wheel (e.g., a software program comprising computer-executable instructions) can be loaded into memory 504 and executed by hardware processor element 502 to implement the steps, functions or operations as discussed above in connection with the example method 400. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for controlling a position of a print media in a registration system of a printing device via at least one omni wheel (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing device, comprising:

a feeder module to feed a print media through the printing device;

a marking module, comprising:

an imaging module to print a desired image onto the print media; and a registration system to align the print media such that the desired image is correctly printed onto the print media by the imaging module, wherein the registration system comprises:

at least one sensor to detect a position of the print media fed from the feeder module;

a first omni wheel and a second omni wheel arranged such that a respective center axis of rotation of the first omni wheel and the second omni wheel are perpendicular to a process direction;

a first motor coupled to first omni wheel and a second motor coupled to the second omni wheel;

a translating carriage located opposite the first omni wheel and the second omni wheel, wherein the at least one sensor is located upstream of the first omni wheel, the second omni wheel, and the translating carriage, wherein the translating carriage comprises:

an idler roller assembly comprising a first idler roller and a second idler roller, wherein the first idler roller is aligned with the first omni wheel and the second idler roller is aligned with the second omni wheel;

at least one bearing coupled to a shaft of the idler roller assembly to limit the idler roller assembly to a rotational movement;

a support shaft coupled to the idler roller assembly via at least one compression spring;

at least one bushing coupled to the support shaft to limit the support shaft to a linear movement along an inboard and outboard direction;

a translating rack coupled to the support shaft; and a translating pinion coupled to the translating rack; and a processor communicatively coupled to the at least one sensor, the first motor, the second motor, and the translating carriage, wherein the processor calculates a desired movement of the first motor, the second motor, and the translating carriage to move the first omni wheel, the second omni wheel, and the translating carriage based on the position of the print media to align the print media with the imaging module that prints the desired image onto the print media, wherein the first omni wheel and the second omni wheel are rotated simultaneously with movement of the translating carriage to simultaneously correct a skew and a lateral input error of the print media; and a finishing module to perform final processing of the print media after the desired image is printed.

2. The printing device of claim 1, wherein the first omni wheel and the second omni wheel are positioned along a common center axis of rotation.

3. The printing device of claim 2, wherein a distance between the first omni wheel and the second omni wheel is approximately equal to a width of the print media.

4. The printing device of claim 1, wherein the first omni wheel and the second omni wheel are located on a same side of the print media.

5. The printing device of claim 1, wherein the first omni wheel and a second omni wheel are on a first side of the print media and the translating carriage is on a second opposite side of the print media.

6. The printing device of claim 1, wherein the desired movement comprises a speed of rotation of the first omni wheel and the second omni wheel and a lateral movement of the translating carriage.

7. The printing device of claim 6, wherein an amount of the desired movement is based on at least one of: the skew of the print media or a lateral position of the print media relative to a desired alignment position.

8. The printing device of claim 6, wherein the first omni wheel and the second omni wheel each comprise:

a central body portion that rotates around the respective center axis of rotation; and a plurality of roller components coupled to an outer periphery of the central body portion, wherein each one of the plurality of roller components rotate around an axis that is perpendicular to the respective center axis of rotation.

9. A printing device, comprising:

a feeder module to feed a print media through the printing device;

a marking module, comprising:

an imaging module to print a desired image onto the print media; and a registration system to align the print media such that the desired image is correctly printed onto the print media by the imaging module, wherein the registration system comprises:

a charge coupled device (CCD) sensor to detect a lateral position relative to a designed alignment location and a skew of the print media fed from the feeder module;

a first omni wheel and a second omni wheel arranged to rotate along a process direction around a respective center axis of rotation of the first omni wheel and the second omni wheel;

a first motor coupled to first omni wheel and a second motor coupled to the second omni wheel to rotate the first omni wheel and the second omni wheel in along the process direction;

a translating carriage located opposite the first omni wheel and the second omni wheel, wherein the charge coupled device is located upstream of the first omni wheel, the second omni wheel, and the translating carriage, wherein the translating carriage comprises:

an idler roller assembly comprising a first idler roller and a second idler roller, wherein the first idler roller is aligned with the first omni wheel and the second idler roller is aligned with the second omni wheel;

at least one bearing coupled to a shaft of the idler roller assembly to limit the idler roller assembly to a rotational movement;

a support shaft coupled to the idler roller assembly via at least one compression spring;

at least one bushing coupled to the support shaft to limit the support shaft to a linear movement along an inboard and outboard direction;

a translating rack coupled to the support shaft; and a translating pinion coupled to the translating rack; and a processor communicatively coupled to the CCD sensor, the first motor, the second motor, and the translating carriage, wherein the processor calculates an amount of desired movement of the first motor, the second motor, and the translating carriage to correct the skew and the lateral position of the print media to align the print media with the imaging module that prints the desired image onto the print media, wherein the first omni wheel and the second omni wheel are rotated simultaneously with movement of the translating carriage to simultaneously correct a skew and a lateral input error of the print media; and a finishing module to perform final processing of the print media after the desired image is printed.

10. The printing device of claim 9, wherein the first omni wheel and the second omni wheel each comprise:

a central body portion that rotates around the respective center axis of rotation; and a plurality of roller components coupled to an outer periphery of the central body portion, wherein each one of the plurality of roller components rotate around an axis that is perpendicular to the respective center axis of rotation.

* * * * *